United States Patent [19]

Cutler, Jr.

[11] 4,194,423

[45] Mar. 25, 1980

[54] COMPACT DIE CUTTING APPARATUS

[75] Inventor: Norman W. Cutler, Jr., Braintree, Mass.

[73] Assignee: Polaroid Corporation, Cambridge, Mass.

[21] Appl. No.: 939,423

[22] Filed: Sep. 5, 1978

[51] Int. Cl.[2] ..... B26D 5/10

[52] U.S. Cl. ..... 83/589; 83/564; 83/557

[58] Field of Search ..... 83/588, 589, 556, 557, 83/559, 563, 568, 566, 569, 570

[56] References Cited

U.S. PATENT DOCUMENTS

| | | | |
|---|---|---|---|
| 386,459 | 7/1888 | Entrekin . | |
| 545,793 | 9/1895 | Gottwals . | |
| 685,212 | 10/1901 | Knowlton . | |
| 1,766,308 | 6/1930 | Rochat . | |
| 2,588,087 | 3/1952 | Connor et al. | 83/564 X |
| 3,085,618 | 4/1963 | Brundage . | |
| 3,194,103 | 7/1965 | Gilman | 83/589 |
| 3,261,250 | 7/1966 | Parks et al. | 83/557 |
| 3,762,258 | 10/1973 | Bender | 83/588 |

FOREIGN PATENT DOCUMENTS

| | | | |
|---|---|---|---|
| 422448 | 1/1935 | United Kingdom | 83/589 |

*Primary Examiner*—Donald R. Schran
*Attorney, Agent, or Firm*—John S. Vale

[57] ABSTRACT

A compact die cutting apparatus that is particularly well suited for cutting individual image sections out of a multiple image photograph of the type provided by a self-developing camera that takes identification photographs having two or more portrait pictures thereon for use on passports, I.D. credit cards, etc. The die cutting apparatus includes a base section with a punch device pivotally and slidably mounted on a lower portion thereof, an actuator assembly that pivots toward and away from the lower portion of the base section and has a cutting die, an image viewing and registration frame, and photograph support thereon, and aligning structure for automatically maintaining a punch cutting head on the punch device in operative alignment with the cutting die as the die is moved in operative relation with the punch cutting head.

13 Claims, 4 Drawing Figures

COMPACT DIE CUTTING APPARATUS

BACKGROUND OF THE INVENTION

1. Field of the Invention

The present invention relates to the field of die cutting apparatus and, more specifically, to a die cutter that is particularly well suited for cutting selected sections out of multiple image photographs.

2. Description of the Prior Art

A fast and economical way to prepare portrait photographs for identification purposes, such as on a passport, I.D. credit card or personnel file folder is to use a self-developing multiple image portrait camera of the general type disclosed in U.S. Pat. Nos. 3,726,198; 3,760,702; 3,774,512; and 3,796,485.

These cameras may include single or twin objective lenses in combination with a fixed or sliding film pack of instant film at the focal plane to provide two portrait images on a single film unit measuring approximately 3"×4" or four such multiple images on a 4"×5" film unit.

The individual photographic portraits are preferably severed or cut out of the film unit by means of a die cutting apparatus. In some applications, such as identification photos that are to be submitted with a passport application, the cut out photographs must meet rigid size specifications (U.S.=2"×2") prescribed by the issuing agency so that accuracy and clean cut edges are very important.

Hand operated die cutting apparatus that may be used for this purpose are, of course, well known in the prior art. However, in general, they do not meet contemporary requirements for low cost, light weight, small size and simplicity of operation and registration of the selected section to be cut out along with accuracy and clean edge cutting.

One important desirable feature is that the operator be able to preview the section to be cut out and accurately register it with the cutting die. U.S. Pat. Nos. 386,456; 685,212; and 3,085,618 provide such a preview feature. However, these die cutters tend to be bulky or oversized in the interest of stability. For example, both of the die cutters shown in U.S. Pat. Nos. 386,456 and 3,085,618 use long actuating lever handles that move either the punch or die. Such relatively large devices are not easily and conveniently stored. The die cutter disclosed in U.S. Pat. No. 685,212 employed a fixed punch on a base in combination with a die that is built into an elongated lever actuating handle which is pivotally coupled to the base to pivot down on the punch. Not only does the long handle contribute to the excessive size of this device, but the fact that the die follows a pivotal or curved path onto the punch, rather than a straight line perpendicular path, means that the die aperture must be large enough to fit onto the punch without binding thereby limiting cutting accuracy and clean edge cutting performance. Other Examples of cutters that use a pivoting punch or die with its inherent accuracy limitation may be found in U.S. Pat. Nos. 545,793 and 1,766,308.

Therefore, it is an object of the invention to provide a relatively compact and small die cutter that is easy to use, requires very little space, provides accurate and clean cuts for cutting out selected sections from a web of material and is especially well suited for cutting out identification portrait images from multiple image photographs.

Other objects of the invention will, in part, be obvious and will, in part, appear hereinafter.

SUMMARY OF THE INVENTION

The present invention provides a compact stable and accurate die cutting apparatus for cutting selected sections out of a web of material. The apparatus is particularly well suited for cutting out individual images from a multiple image photograph.

Compactness and mechanical simplicity are facilitated by die cutting actuator which carries a viewing and registration frame, a cutting die and a web support and is pivotally mounted on a base section for angular displacement toward and away from a punch device mounted on the base section below the actuator. Advantageously the punch device is mounted on the base section for both angular displacement and sliding motion and the apparatus further includes punch alignment means which provides a rotating and sliding force on the punch device and maintains its punch cutting head in alignment with the cutting die. Thus, while the die and punch cutting pivot, they do so in a complementary manner so that the relative motion of the die and cutting head is along straight line path of travel therebetween thereby allowing a close fit between the cutting edges of the punch and die. This construction facilitates accurate clean edge cuts rather than having loose fitting punch and die elements that provide less accurate cuts but are generally necessary where either the die or punch pivots and the other is fixed to prevent binding.

BRIEF DESCRIPTION OF THE DRAWINGS

For a fuller understanding of the nature and objects of the present invention reference may be had to the following detailed description taken in connection with the accompanying drawings wherein.

DESCRIPTION OF THE PREFERRED EMBODIMENT

Figure 1:
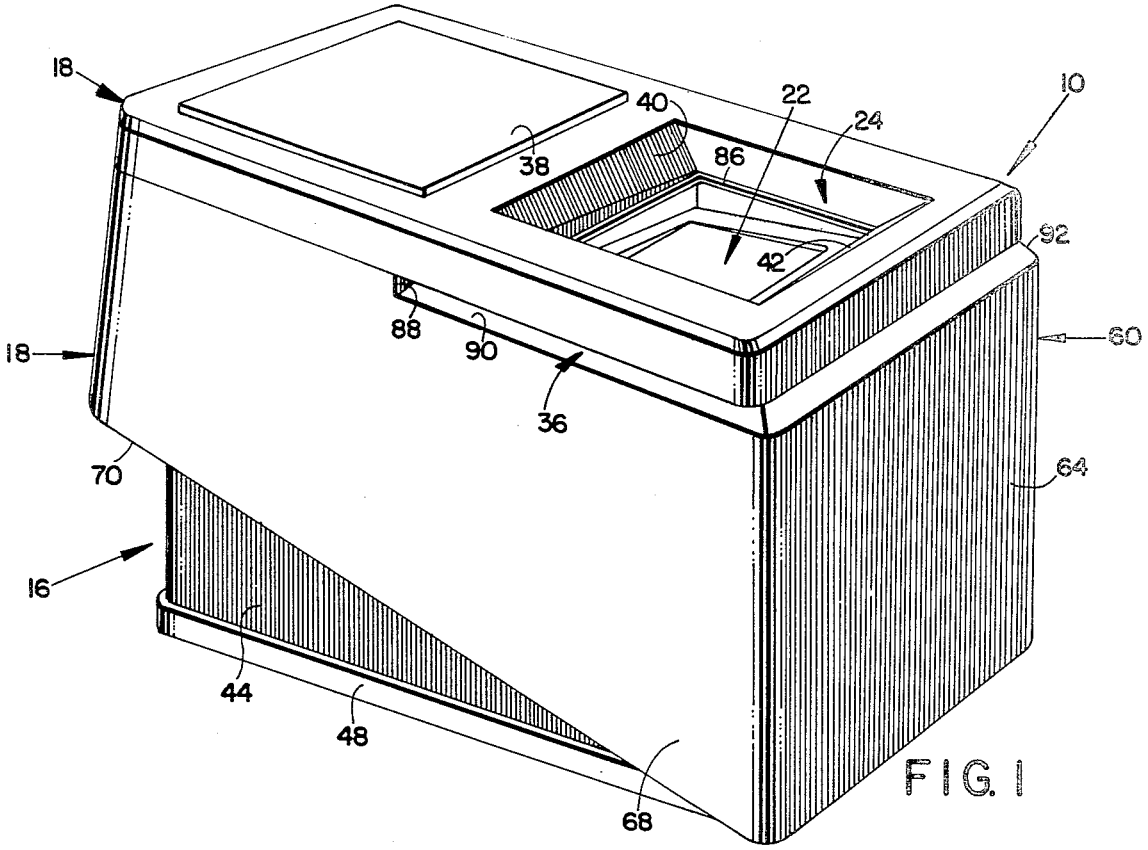
FIG. 1 is a perspective view of a die cutting apparatus embodying the present invention.
Figure 2:
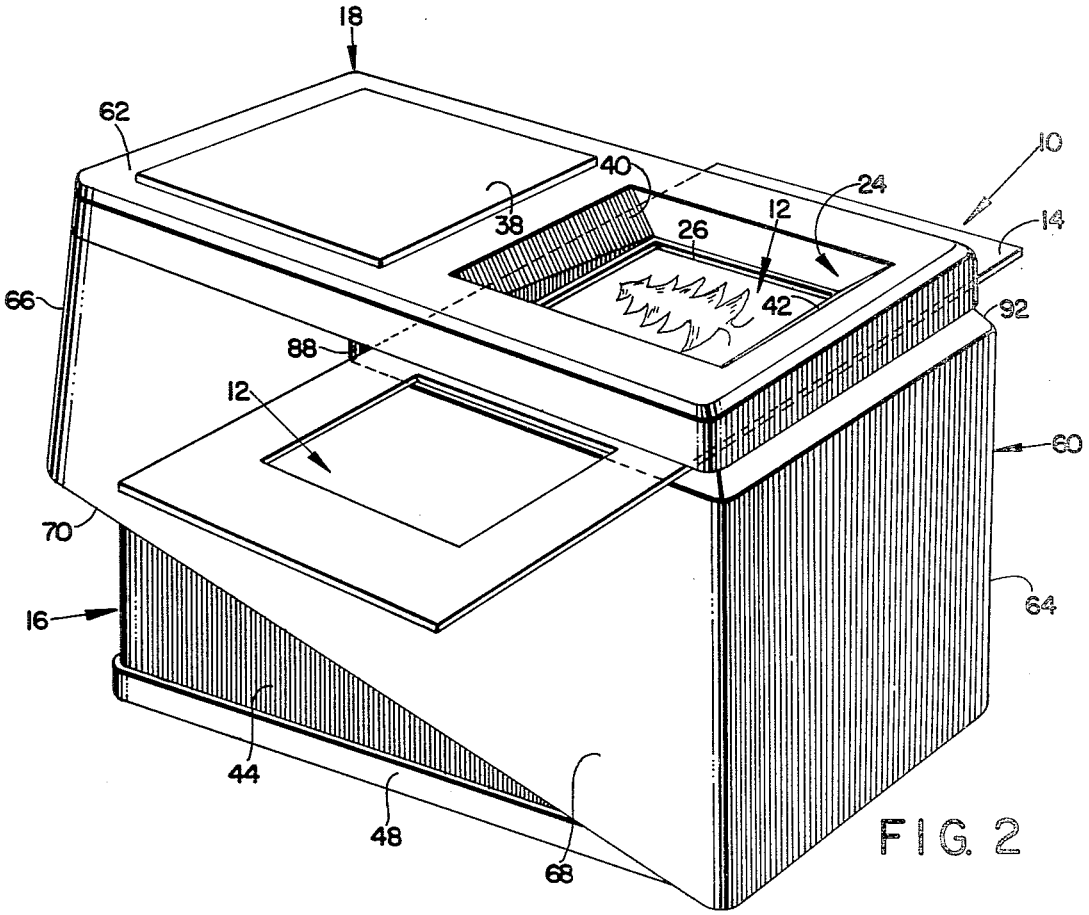
FIG. 2 is a perspective view of the die cutting apparatus of FIG. 1 showing a multiple image photograph located in operative relation therewith.

FIGS. 1 and 2 of the drawings show a perspective view of a die cutting apparatus 10, embodying the present invention, for cutting selected sections 12 out of a web of material such as the illustrated photograph or film unit 14 having multiple images thereon.

The illustrated die cutter 10 is configured to cut out square sections and is especially well suited for severing 2"×2" passport identification photographs from film unit 14. As noted earlier, die cutter 10 may be used to cut two such portrait sections 12 from a 3"×4" self-developing film unit 14 or four such sections 12 from a larger 4"×5" film unit 14.

Die cutter 10 is relatively compact, measuring approximately 6.5"×4.5"×3.5", and has a generally box-like shape. Its major elements include a base section 16, an actuator assembly 18 pivotally coupled to base section 16, a die punch device 20 (see FIGS. 3 and 4) including a punch cutting head 22 visible in FIG. 1 through an open viewing and registration frame 24, and a die aperture 26 in a cutting die 27 on actuator assembly 18, and a punch aligning mechanism 28 comprising at least one guide pin 30 fixedly mounted on actuator assembly 18 and at least one pin receiving insert 32 on punch device 20 having a cylindrical bore 34 for receiving pin 30 in sliding relation thereto (see FIGS. 3 and 4).

As best shown in FIGS. 1 and 2, the film unit 14 is inserted into an entry slot 36 on assembly 18 and is manually manipulated by the operator until the selected section 12 appears within the bounds of frame 24. He then pushes downwardly on the one end of assembly 18 (to the left of frame 24), which may optionally include the illustrated rubber pad 38 to provide a cushioned non-slip surface for the palm of the hand, causing relative movement of the die 27 and punch cutting head 22 (see FIGS. 3 and 4). Cutting head 22 and die 27 cooperate to cut out the registered section 12 and it is supported at the bottom of the square recess defined by frame 24. The severed section 12 may be easily removed from this recess by sliding it toward either longitudinal end of frame 24 and sliding it upwardly along inclined guide ramp surfaces 40 or 42 forming an integral part of frame 24.

Figure 4:
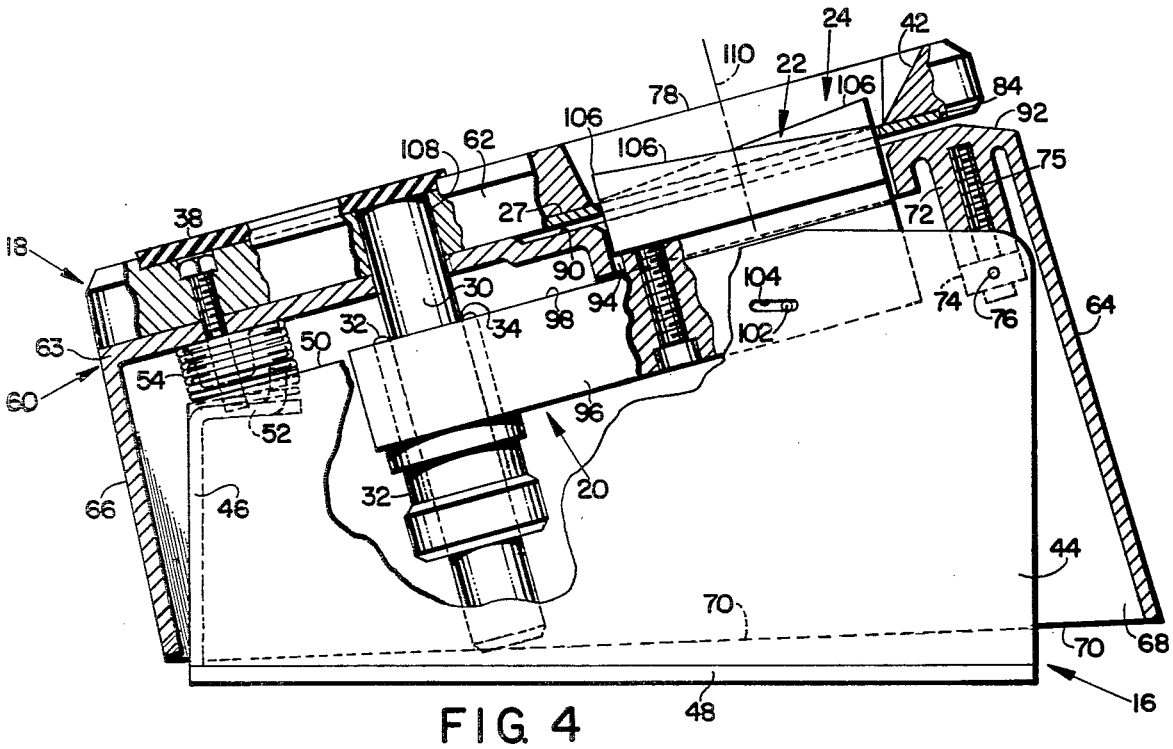
FIG. 4 is a cross-sectional view, partly in section, of the die cutter showing the cooperative locations of the die and punch cutting head when the actuator handle is down or depressed.

The base section 16 serves to support apparatus 10 and mount various apparatus components thereon. It comprises a generally U-shaped support frame member, defined by parallel spaced side walls 44 and an integrally formed end wall 46, and a bottom wall or support frame base 48. The support frame defined by walls 44 and 46 may be formed of a single sheet of aluminum or the like while base 48 is preferably formed of a resilient material such as rubber to provide a non-marring, non-slip underside of base section 16. It will be noted that the top edge 50 of side walls 44 inclines upwardly from end wall 46 toward the free ends of walls 44 to provide clearance for the downward pivotal movement of actuator assembly as shown in FIG. 4. Preferably end wall 46 includes an integrally formed L-shaped flange 52, extending inwardly and upwardly from its top edge, for supporting and securing the lower end of a helical actuator return spring 54 having its opposite end captured by a screw 56 and nut 58 on assembly 18.

The means for actuating operation of die cutter 10 includes the multi-functional actuator assembly 18. In addition to serving as a die cutter actuating lever, it also supports cutting die 27, provides the viewer and registration frame 24, supports a portion of the web of material in operative relation with cutting die 27 and punch cutting head 22 and supports the punch aligning guide pin 30.

In a preferred embodiment assembly 18 comprises a lower open bottom box-like member 60 that fits over base section 16 in nesting relation thereto and an upper plate 62 secured to member 60, by means of screw 56 and nut 58, which defines frame 24, supports cutting die 27 and cooperates with lower member 60 to define web entry slot 36.

Lower member 60 is preferably of molded plastic construction and includes a generally horizontal (as viewed in FIG. 3) top wall 63 and a vertically depending peripheral skirt defined by a leading end wall 64 adjacent frame 24, a shorter opposing trailing end wall 66 and a pair of opposed side walls 68 joining walls 64 and 66 and having an inclined lower bottom edge 70 extending upwardly from the bottom of wall 64 to the bottom of wall 66.

Integrally formed with top wall 63 and depending vertically therefrom near end wall 64 is a coupling block 72 which is secured, by screws 75, at its bottom end to a complementary coupling block 74 that extends between side walls 44 of base section 16 and is pivotally coupled to an upper portion of base section 16 by means of pins 76 that extend outwardly from the opposite ends of block 74 and through shaft bearing holes in side walls 44 at their upper right hand end. By this structure, the actuating means, i.e. assembly 18, is pivotally coupled to the upper portion of base section 16 for angular displacement toward and away from the lower portion of base section 16, that is any part of base section 16 below pivot pins 76, between the up and down terminal positions of assembly 18 shown in FIGS. 3 and 4 respectively.

The upper actuator plate 62 is preferably of cast aluminum or molded plastic construction and is secured to top wall 63 of lower member 60 by means of screw 56 and nut 58 as previously noted.

The generally square viewing and registration frame 24 is preferably integrally formed with plate 62 and extends therethrough from the top exterior surface 78 to its underside surface 80 where frame 24 defines a generally square aperture 82 that is at least coextensive and aligned with the square die aperture 26 of cutting die 27 secured to the underside of plate 62 by any suitable means in a recess 84 provided therein. Cutting die 27 comprises a die plate having a square cutting edge section 86 which defines the bounds of die aperture 26. Die 27 is mounted on plate 62 in a predetermined plane that is substantially parallel to the surfaces 78 of plate 62 and top wall 63 of member 60. As noted earlier, frame 24 includes the two inclined ramp guide surfaces 40 and 42 extending upwardly from frame aperture 82, at the lower portion of frame 24, to top surface 78. Surface 40 is inclined toward the trailing end of assembly 18 and surface 42 is inclined toward its leading end.

Below frame 24, the top wall 63 of lower member jogs downwardly from the underside surface 80 of plate 62 at vertical surface 88 to define a web support surface portion 90 of wall 63 that extends horizontally to the right (as viewed in FIG. 3) from surface 88, under frame 24 to a point just before the leading end of plate 26 where it inclines downward to leading end wall 60 to form a web insertion guide ramp 92. Integrally formed in a wall portion 90 is a square aperture 94, aligned with die aperture 27, which serves as an access opening to the punch cutting head 22 for die 27 as will be apparent later.

The underside surface 80 of plate 62 and the spaced top web supporting surface of wall portion 90 cooperate to define the web insertion slot 36 which is open and extends around three sides of the cutting die 27 permitting the multi-image photograph to be easily manipulated on the support surface to register the selected section with frame 24. The vertical surface 88 may be used as a stop or bearing surface for an edge of the film unit and its location with respect to the adjacent edge 86 of die aperture may be selected to correspond to the location of the image relative to the film unit edge.

The punch device 20 comprises a generally parallelepiped shaped base plate 96 including at top planar reference surface 98, the punch cutting head 22 which is secured to base plate 96, by screws 100 (only one shown), at the right end of plate 96 in upstanding perpendicular relation to reference surface 98 and the guide pin receiving insert 32 which is press fitted into a receiving hole in plate 96 such that the axis of its central bore 34 is perpendicular to reference surface 98.

Punch device 20 is located between the side walls 44 of base section 16 with head 22 extending into access aperture 94 and is coupled to the lower portion of base 16 for pivotal sliding motion relative thereto by means of mounting pins 102 that extend outwardly from the side of base plate 96 in parallel relation to reference surface 98 under the center of head 22 and into moderately elongated bearing slots 104 in side walls 44 of base section 16 to the left (as viewed in FIG. 3) of actuator assembly pivot pins 76.

The punch cutting head 22 is a generally square block-like structure having an upper square peripheral cutting edge section defined by four cutting edges 106 that are inclined with respect to reference surface 98. It will be noted that opposing cutting edges 106 have opposite slopes. Those skilled in the die cutting art will recognize that this preferable cutting edge structure, which cuts an edge of the selected web section progressively in a slicing manner in response to progressive displacement of the die cutting edges 86 and the punch cutting edges 106 towards each other, provides a very clean edge cut especially on coated photographic stock.

The punch cutting device aligning guide pin 30 is preferably fixedly secured to actuator assembly 18 by press fitting its top and into a cylindrical aperture 108 in upper plate 62. Pin 108 is located on assembly 18 such that its axis is perpendicular to the predetermined plane of die 27 and it is dimensioned to snuggly fit into and slide within the bore 34 of insert 32 thereby maintaining the reference surface 98 of punch device 20 in parallel relation to the predetermined plane of die 27 and the upstanding punch cutting head 22 thereon in perpendicular relation thereto.

Figure 3:
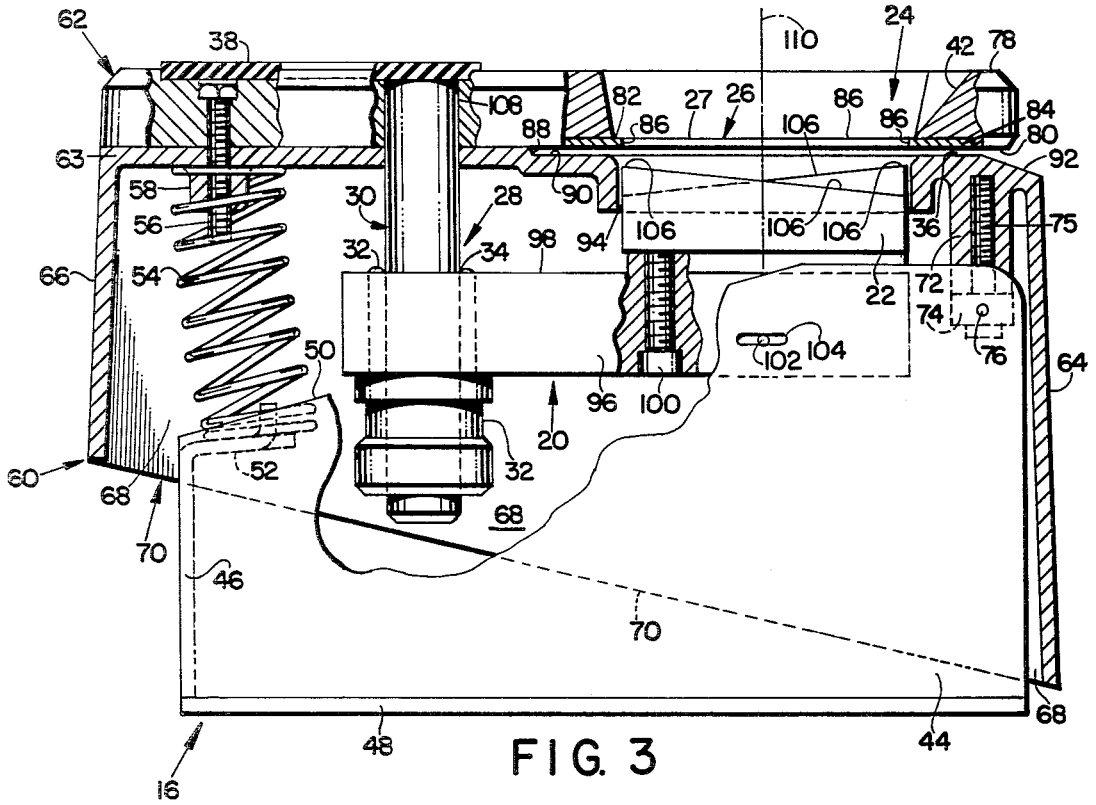
FIG. 3 is a cross-sectional view, partly in section, of the die cutter showing its actuator handle in the up position with the die and punch cutting head in spaced apart relation.

While the drawings show only a single guide pin 30 and pin receiving insert 32 and such a single structure will perform the desired alignment function, die cutter 10 may include a second set of a pin 30 and insert 32 located directly behind the set shown in FIGS. 3 and 4 to provide reduced force loading and wear on the individual pins 30 and inserts 32 and improve lateral stability of the punch device by preventing twisting.

The die cutting apparatus 10 is shown in its normal position in FIG. 3 with actuating means or actuator assembly 18 held in its up position by spring 54. The upper actuator plate 62 and the cutting die 27 thereon are located in a substantially horizontal plane. The guide pin 30 is vertically disposed in perpendicular relation to plate 62 and by its cooperation wih pin receiving insert 32 it maintains the pivotally and slidably mounted base plate 96 of punch device 20 in a horizontal plane such that reference surface 98 is parallel to the plane of die 27 thereby aligning the punch cutting head 22 in perpendicular relation with die aperture 26. As will become apparent the punch device aligning means in the form of pin 30 and pin receiving insert 32 will maintain this same alignment during the cutting operation when actuator assembly 18 is pivoted downwardly to advance the die 27 toward cutting head 22 along the perpendicular path of travel 110 therebetween which is parallel to the axis of guide pin 30. It will be noted, in the normal position the mounting pins 102 for punch device 20 are about in the center of the elongated mounting and guide slots 104 in base section side walls 44.

In operation, the operator inserts the multiple image photograph or film unit 14 in slot 36 and, with one hand, slides it about on the support surface (top exterior surface of portion 90 of top wall 63) until the selected section 12 (one of the images on film unit 14) is registered in frame 24. Then, with the other hand, he pushes downwardly on pad 38 toward base section 16 to pivot actuator assembly 18 in a counterclockwise direction relative to the fixed base section 16 about actuator pivot pins 76. Because die 27 and pin 30 are fixed on assembly 18, they are angularly displaced in the same rotational direction toward the punch device 20 on the lower portion of base section 16. This downward pivotal motion of assembly 18 slidingly drives the pin 30 through the bore 34 of pin receiving insert 32 and advances the cutting die 27 and support means carrying the registered photograph 14 downwardly toward the punch cutting head 22.

As the aligning guide pin 30 slides through pin receiving insert 32 it imparts a force on punch device 20 which causes it to pivot in a counterclockwise direction about pins 102 and slide slightly to the right to automatically maintain the cutting head 22 in precise perpendicular alignment with the cutting die 27 advancing along path 110. As the die 27 and punch cutting head 22 are brought into operative relation, their respective cutting edge sections defined by cutting edges 86 and 106 cooperate to produce the shearing action to cut out the registered section 12 of film unit 14.

FIG. 4 shows the actuator assembly 18 in its down terminal position. It will be seen that at the end of the down stroke the die 27 has been fully received by the cutting head 22, the upper portion of which extends into the lower portion of frame 24 to support the cut out section 12 (not shown) therein. While holding actuator assembly 18 down with one hand, the operator may reach into frame 24 and push the cut out section 12 to the left or right and easily slide it up and out of frame 24 along the corresponding inclined guide ramp surface 40 or 42.

Once the cut out section 12 is removed from frame 12 the operator merely releases actuator assembly 18 and it pivots upwardly in a clockwise direction under the influence of spring 54. During the upward movement the aligning pin 30 slides through insert 32 and provides the proper force to device 20 to pivot it in a clockwise direction and slide it to the left slightly relative to base section 16 to automatically maintain its operative alignment with die 27. To cut out the next image on the photograph, the operator slides film unit 14 over the support surface until the second image is registered and then repeats the die cutting procedure.

Since certain changes may be made in the above die cutting apparatus without departing from the scope and spirit of the invention herein involved, it is intended that all matter contained in the above description or shown in the accompanying drawings shall be interpreted as illustrative and not in a limiting sense.

I claim:

1. A die cutting apparatus for cutting selected sections out of a web of material, said die cutting apparatus comprising:

a base section for supporting said apparatus and mounting various apparatus components thereon, said base section including an upper portion and a lower portion;

actuating means for actuation operation of said apparatus, said actuating means being pivotally coupled to said upper portion of said base section for angular displacement toward and away from said lower portion of said base section;

a cutting die disposed on said actuating means for angular displacement therewith and including a die aperture bounded by a cutting edge portion of said cutting die;

a punch device including a punch cutting head having a cutting edge portion thereof, said punch being mounted on said lower portion of said base section for pivotal angular displacement and sliding motion relative thereto and said punch cutting head being configured to be operatively aligned with said die aperture for receiving said cutting edge portion of said die in response to said cutting die being advanced along a substantially perpendicular path of travel therebetween into operative relation with said punch cutting head when said actuator means is angularly displaced toward said lower portion of said base section and said punch device mounted thereon whereby said cutting edge portions of said cutting die and said punch cutting head cooperate to cut out a selected section of a portion of a web of material located between said cutting edge portions; and punch aligning means, responsive to angular displacement of said actuating means towards and away from said lower base section portion and said punch device thereon, for automatically angularly displacing and sliding said punch device relative to said lower base section to maintain said punch cutting head in operative alignment with said cutting die aperture such that relative movement between said cutting die and said punch cutting head is confined to said substantially perpendicular path of travel therebetween.

2. The die cutting apparatus of claim 1 wherein said punch aligning means exerts a force on said punch device, in response to angular displacement of said actuating means, for angularly displacing said punch device in a rotational direction that is in the same rotational direction in which the cutting die is moved by said actuating means.

3. The die cutting apparatus of claim 2 wherein said alignment means includes at least one guide pin fixedly secured to said actuating means and pin receiving means on said punch device for receiving a portion of said one guide in sliding relation thereto.

4. The die cutting apparatus of claim 1 wherein said cutting die is disposed on said actuating means in a predetermined plane, said punch device includes a base plate having a substantially planar base surface on which said punch cutting head is disposed in upstanding substantially perpendicular relation thereto and in facing relation to said cutting die and said alignment means is configured to exert a force on said punch device to angularly displace and slide said punch device in response to angular displacement of said actuator means, to maintain said substantially planar base reference surface in substantially parallel relation to said predetermined plane of said cutting die.

5. The die cutting apparatus of claim 1 wherein said actuating means includes an open viewing and registration frame therein defining a registration aperture that is coextensive and aligned with said cutting die aperture in communicating relation thereto and through which the operator may view, within the bounds of said registration aperture, the selected section of the web to be cut when a portion of the web is located between said cutting die and said punch cutting head.

6. The die cutting apparatus of claim 5 further including web support means for supporting a portion of the web in adjacent underlying relation to said cutting die.

7. The die cutting apparatus of claim 6 wherein said support means includes a planar web support surface on said actuator means disposed in substantially parallel underlying relation to said cutting die and having a coextensive aperture therein aligned with said die aperture and being spaced from said cutting die to define a slot into which the web portion may be inserted to assume its supported position in operative relation to said cutting die.

8. The die cutting apparatus of claim 5 wherein said viewing and registration frame defines a recess in said actuating means extending downwardly from a top exterior portion of said actuating means to said die aperture, said cut out section of the web is supported in a lower portion of said viewing and registration frame following its severing from the web portion, and said viewing and registration frame is defined by at least one inclined ramped guide surface extending between said lower portion of said frame and said top exterior portion of said actuating means and along which the operator may slide the cutout section upwardly to facilitate its removal from said recess.

9. A die cutting apparatus for cutting selected sections out of a web of material, said die cutting apparatus comprising:

a base section for supporting said apparatus and mounting various apparatus components thereon, said base section including an upper portion and a lower portion;

actuating means for actuating operation of said apparatus, said actuating means being pivotally coupled to said upper portion of said base section for angular displacement toward and away from said lower portion of said base section;

a cutting die disposed on said actuating means for angular displacement therewith and including a die aperture bounded by a cutting edge portion of said cutting die;

means for defining an open viewing and registration frame on said actuating means for viewing a selected section of the web and registering it with respect to said cutting die, said frame defining a registration aperture that is at least coextensive and in aligned communication with said die aperture;

support means on said actuator means for supporting a portion of the web in operative relation with said die aperture;

a punch device including a punch cutting head having a cutting edge portion thereof, said punch device being mounted on said lower portion of said base section for pivotal angular displacement and sliding motion relative thereto and said punch cutting head being configured to be operatively aligned with said die aperture for receiving said cutting edge portion of said die in response to said cutting die being advanced along a substantially perpendicular path of travel into operative relation with said punch cutting head when said actuator means is angularly displaced toward said lower base section and said punch device mounted thereto whereby said cutting edge portions of said cutting die and punch cutting head cooperate to cut out a selected section of a portion of the web supported by said support means intermediate said cutting die and said punch cutting head; and punch aligning means, responsive to angular displacement of said actuating means towards and away from said lower base section portion and said punch device thereon, for automatically angularly displacing and sliding said punch device relative to said lower base section portion to maintain said punch cutting head in operative alignment with said cutting die aperture such that relative movement between said cutting die and said punch cutting head is confined to said substantially perpendicular path of travel therebetween.

10. A die cutting apparatus for cutting selected sections out of a web of material, said die cutting apparatus comprising;

a base;

actuating means for actuation operation of said apparatus, said actuating means being pivotally coupled over said base section for angular displacement toward and away from said base section;

a cutting die disposed on said actuating means for angular displacement therewith;

a punch device including a plate member having a punch cutting head, said plate member being mounted on said base for pivotal and sliding motion relative thereto; and punch aligning means, responsive to angular displacement of said actuating means towards and away from said base and said punch device thereon, for automatically angularly displacing and sliding said punch device relative to said base to maintain said punch cutting head in operative alignment with said cutting die such that relative movement between said cutting die and said punch cutting head is confined to a substantially perpendicular path of travel therebetween, said punch aligning means including at least one guide member depending from said actuating means into sliding engagement with said plate member for maintaining perpendicular movement between said plate member and said actuating means during displacement of said actuating means.

11. The die cutting apparatus of claim 10 wherein said one guide member comprises at least one guide pin fixedly secured to said actuating means and said plate member includes an opening therein for receiving a portion of said one guide in sliding relation thereto.

12. A die cutting apparatus for cutting selected sections out of a web of material, said die cutting apparatus comprising:

a base assembly comprising a base member having a support frame extending generally perpendicular thereto;

an actuating member comprising a plate member mounted at one end of said support frame for pivotal movement toward and away from said base member and having a depending skirt extended toward said base member so as to enclose said support frame, said plate member having an open registration frame located near said one end, a cutting die located beneath said registration frame, and a web receiving slot positioned beneath said cutting die for receiving and supporting at least a portion of the web thereat; a punch cutting head mounted on said support frame so as to be supported over said base member in alignment with said cutting die; and means for biasing said actuating member away from said base member so that the web may be inserted in said receiving slot between said cutting die and said punch head and permitting said actuating member to be displaced toward said base to cut a section from said web.

13. The die cutting apparatus of claim 12 wherein said actuating member has an exterior surface, said registration frame has a lower portion thereof, below said exterior surface, where said punch cutting head supports the cut out section when said actuating member is displaced toward said base member and said registration frame includes at least one inclined guide surface, located between said lower portion of said registration frame and said exterior surface, along which the cut out section may be advanced to facilitate its removal from said registration frame.

* * * * *